US005154951A

United States Patent [19]

Finnicum et al.

[11] Patent Number: 5,154,951

[45] Date of Patent: Oct. 13, 1992

[54] METHOD AND APPARATUS FOR USE IN BEAD COATING A WEB WITH LIQUID COMPOSITION

[75] Inventors: Douglas S. Finnicum, Webster; Jack A. Pegoni, Brockport; Thomas E. Story, Penfield, all of N.Y.

[73] Assignee: Eastman Kodak Company, Rochester, N.Y.

[21] Appl. No.: 499,157

[22] Filed: Mar. 26, 1990

[51] Int. Cl.[5] ..... B05D 1/26

[52] U.S. Cl. ..... 427/402; 427/420; 118/DIG. 2; 118/410; 118/411

[58] Field of Search ..... 427/402, 420; 118/DIG. 2, 410, 411

[56] References Cited

U.S. PATENT DOCUMENTS

| | | | |
|---|---|---|---|
| 3,220,877 | 6/1962 | Johnson | 117/120 |
| 3,502,494 | 3/1966 | Ishiwata et al. | 117/34 |
| 3,916,043 | 10/1975 | Fowble | 427/294 |
| 4,340,621 | 7/1982 | Matsuiya et al. | 427/294 |
| 4,545,321 | 10/1985 | Bassa | 118/50 |

FOREIGN PATENT DOCUMENTS

| | | | |
|---|---|---|---|
| 121451 | 6/1987 | Japan | 430/935 |

*Primary Examiner*—Shrive P. Beck
*Attorney, Agent, or Firm*—John B. Turner

[57] ABSTRACT

Disclosed are apparatus and method for bead coating a web with liquid composition with a pressure differential applied across the bead of composition between the lip of the slide hopper and the web. An enclosure is disposed under and open to the bead. Vacuum is applied to the enclosure by a turbine driven by an AC induction motor. Servo means are provided for regulating the speed of the motor and thereby the pressure differential across the bead. The AC motor and the servo means allow the desired pressure to be maintained without surges and allows the differential pressure to be rapidly changed, as for the passage of a splice in the web through the bead.

5 Claims, 3 Drawing Sheets

METHOD AND APPARATUS FOR USE IN BEAD COATING A WEB WITH LIQUID COMPOSITION

BACKGROUND OF THE INVENTION

1. Field of the Invention

This invention relates to methods and apparatus for use in bead coating a web with liquid composition.

2. Description relative to the Prior Art

U.S. Pat. No. 3,220,877, to Johnson and issued Nov. 30, 1965, describes a method of coating a web with liquid composition, for example, photographic composition, using a slide hopper. Compositions to be coated in layers on a web are forced out of slots onto slide surfaces of the hopper. The materials slide down the slide surfaces, stacking up on one another as they flow down. The stacked layers come to the hopper lip at the bottom of the slide surfaces. Opposite the lip the web to be coated is moving upwardly around a coating roll which serves to back up the web at the coating point and to accurately space the web from the hopper lip. The layers flow off the hopper lip and bridge the gap and flow onto the web. The layers, when in the gap, are said to form a bead, from which the term "bead coating" is derived.

The aforesaid patent specification further describes the provision of a pressure differential across the bead, with the lower pressure being on the underside of the bead. The pressure differential is greater during the start of a coating operation and is lowered for the remainder of the coating operation, when the hopper has been backed away from its very close start-up position. The pressure differential is created by providing a casing under the bead, which, together with a portion of the hopper and a portion of the web on the coating roll, bound a chamber. Air is withdrawn from the chamber by a vacuum pump. The magnitude of the pressure differential is controlled by a regulating valve.

U.S. Pat. No. 3,916,043, to Fowble and issued Oct. 28, 1975, describes increasing the pressure differential when a splice in the web passes through the gap between the hopper lip and the web on the coating roll. Again, a regulating valve is provided in the conduit between the chamber under the bead, and the vacuum source.

It has been found that when a regulating valve is used to regulate the magnitude of the pressure differential across the bead, the pressure differential maintained is not constant. Variations, in the form of surges, in the pressure differential create variations in the uniformity of the laydown of the compositions on the web. Such variations in uniformity of laydown are particular apparent and objectionable in motion picture film which is used to present successive images, on successive portions of the film, to the eye. Furthermore, poor repeatability of the pressure differentials desired for start up, run and passage of a splice, contribute to other problems, such as excess coverage, bead pull-through, pencil lines, crosslines, breaklines and streaks, encountered in the manufacture of photographic film.

It is an object of the present invention to overcome the above problems.

SUMMARY OF THE INVENTION

The object of the present invention is achieved by regulating the speed of a vacuum producing turbine in order to maintain and change the pressure differential across the bead, as distinct from throttling a constant speed vacuum pump. It has been found that by regulating the speed of a vacuum producing turbine, instead of throttling a constant speed vacuum pump, pressure surges can be avoided. With a more stable and repeatable pressure differential across the bead, the uniformity of laydown of photographic compositions on the web is much improved, and the waste encountered at start up and splice passage through the gap, is much reduced.

The speed of a vacuum producing turbine may, in accordance with the present invention, be regulated and changed, by providing an AC motor for driving the turbine and controlling the motor with AC servo drive means.

BRIEF DESCRIPTION OF THE DRAWINGS

An embodiment of the present invention will now be described, by way of example, with reference to the accompanying drawings, in which.

DETAILED DESCRIPTION OF THE PREFERRED EMBODIMENT

Figure 1:
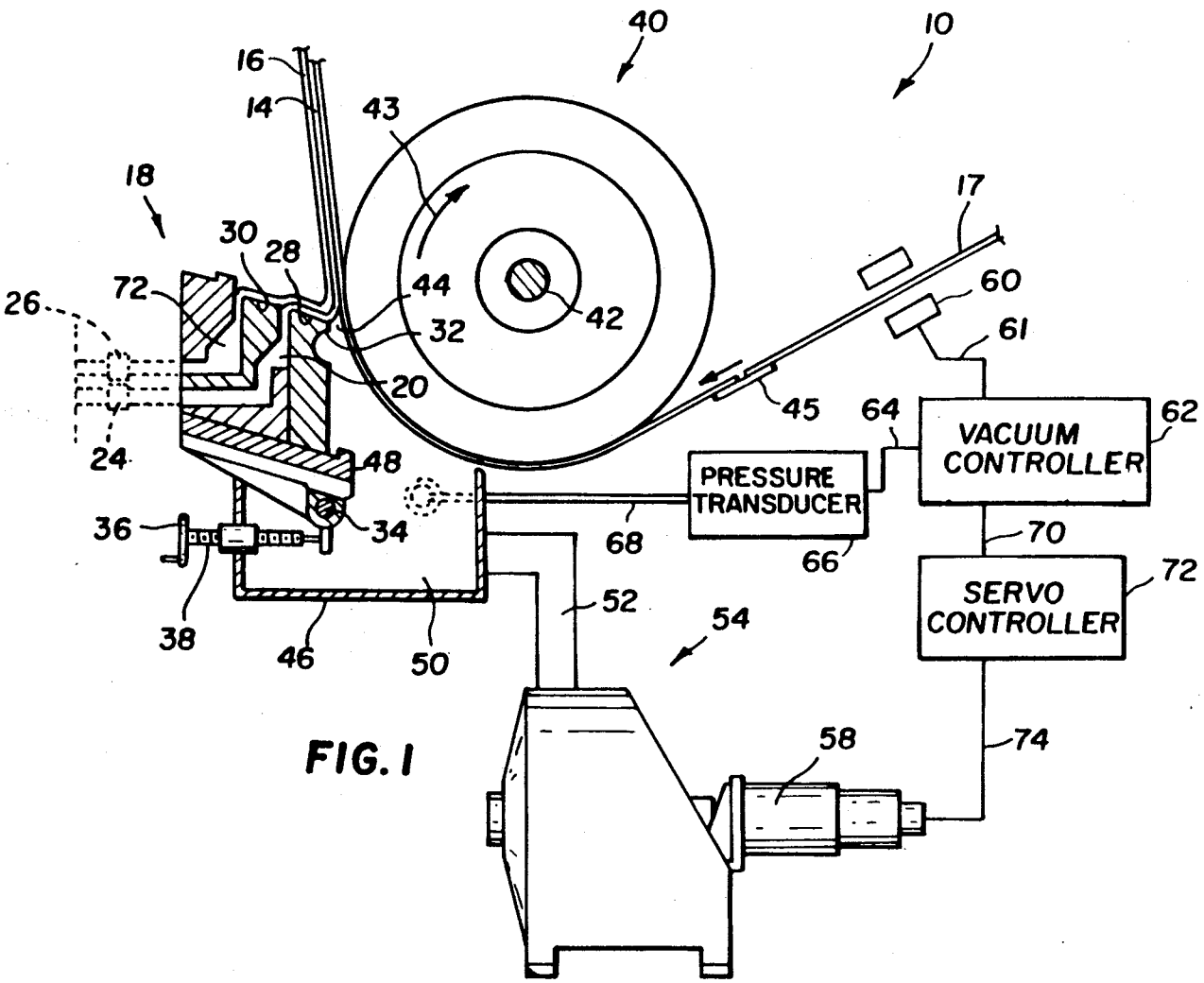
FIG. 1 is a schematic representation of bead coating apparatus in accordance with the present invention.

Illustrated in FIG. 1 is apparatus 10 for coating a web 12 with two layers 14 and 16 of photographic compositions. The compositions are applied as two layers by a known slide hopper 18. In known manner, the hopper 18 includes two cavities 20, 22 to which the different compositions are supplied by supply means 24 26, respectively. The compositions flow from the cavities 20, 22, through distributing slots 20*s*, 22*s*, respectively, onto inclined slide surfaces 28, 30, respectively. The lower end of the lower slide surface 28 is at a lip 32. The hopper is mounted on a shaft 34 which is horizontal. Means, represented by a handwheel 36 and threaded shaft 38, are provided for positioning the hopper 18 about the shaft 34.

Adjacent the hopper 18 is a coating roll 40 which is driven in rotation, at constant speed, by a horizontal shaft 42, which is parallel to the shaft 34. The web 12 is wrapped about the roll 40 and the roll serves to accurately position the web 12 as it passes close to the hopper lip 32. In operation, the roll rotates clockwise, see the arrow 43 in FIG. 1, and the web moves past the hopper lip upwardly. A small gap 44 is formed between the lip 32 and the web 12. The size of the gap 44 is adjustable by rotating the handwheel 36 so that the hopper is displaced about the shaft 34. As is known, the size of the gap is varied for starting a coating operation, running the operation and for allowing a splice 45 to pass between the lip 32 and the roll 40.

Compositions flowing down the slide surfaces 28, 30 as discrete but contiguous layers, bridge the gap 44 in what is known as a bead. The layers flow through the bead without mixing and form the layers 14, 16 on the web 12.

For the purpose of applying a pressure differential across the bead, there is provided a casing 46, having end walls 48, which together with the hopper 18 and a portion of the roll 40, bound a chamber 50. Air can be withdrawn from the chamber along conduit 52 to create a sub-atmospheric pressure in the chamber 50. In this way, a pressure differential is created across the bead, with the lower pressure being on the underside of the bead.

U.S. Pat. No. 3,916,043 describes the advantages to be gained if the differential pressure on the opposite sides of the bead is increased just before a splice in the web reaches the gap and is maintained in such elevated condition during the time the splice is passing the gap and for a short time thereafter. After the splice has passed the gap and stable conditions have been restored, the pressure in the chamber is returned to normal running pressure. Such a procedure had been found to greatly decrease the coating problems caused by passage of the splice through the gap. For a full understanding of the procedure for, and advantages of, adjusting the vacuum for different events in coating, reference is directed to the aforementioned U.S. Pat. No. 3,916,043. The pressure differential applied during starting a coating operation may be more or less than the pressure differential applied during the passing of a splice and is more than the differential applied during normal coating.

In accordance with the present invention, the magnitude of the pressure differential is changed by adjusting the speed of a turbine 54. The turbine is driven by variable speed motor means which, in the present embodiment, is in the form of an AC induction motor 58. Means are provided for regulating and rapidly changing the speed of the motor means, as will now be described.

At a known web path distance from the gap 44, there is a splice detector 60 which serves to detect a splice 45 in the web 12 as it passes the detector. The detector sends, over line 61, a signal, indicative of the passing of a splice in the web, to a vacuum controller 62. The vacuum controller also receives, over line 64, signals indicative of the pressure in the chamber 50. The pressure signals are derived from a pressure transducer 66 which has pressure in the chamber 50 applied to it through conduit 68. The vacuum controller 62 is adapted to provide a speed reference signal, over line 70, indicative of the speed the turbine is to be driven at so as to provide a desired pressure in the chamber 50. The speed reference signal from the vacuum controller 62 is applied to a servo controller 72 which is connected to the servo 58 by line 74.

In one embodiment of the present invention, the motor is marketed by General Motion of 6000 Culligan Way, Minnetinka, Minn., U.S.A. and has their model number AM-044. The servo and servo controller include True Servo (TM) AD-009 and a PS-100 amplifier also marketed by General Motion. This is a closed loop variable speed system which provides constant power operation, satisfactory speed control and the ability to rapidly change motor speed. The system consists of solid state integrated PWM drives. The AC induction motor has an integral speed detector, in the form of an optical encoder 75 (see FIG. 2), to enable closed loop operation. Using microprocessor-based field orientation, the drive enables the AC motor to run smoothly from 0 to 3000 RPM. Such a system forms one embodiment of a high acceleration AC servo drive means adapted to rapidly change the speed of the motor means. Other embodiments of means for regulating, including rapidly changing, the speed of motor means for driving the turbine will be apparent to those skilled in the art.

Figure 2:
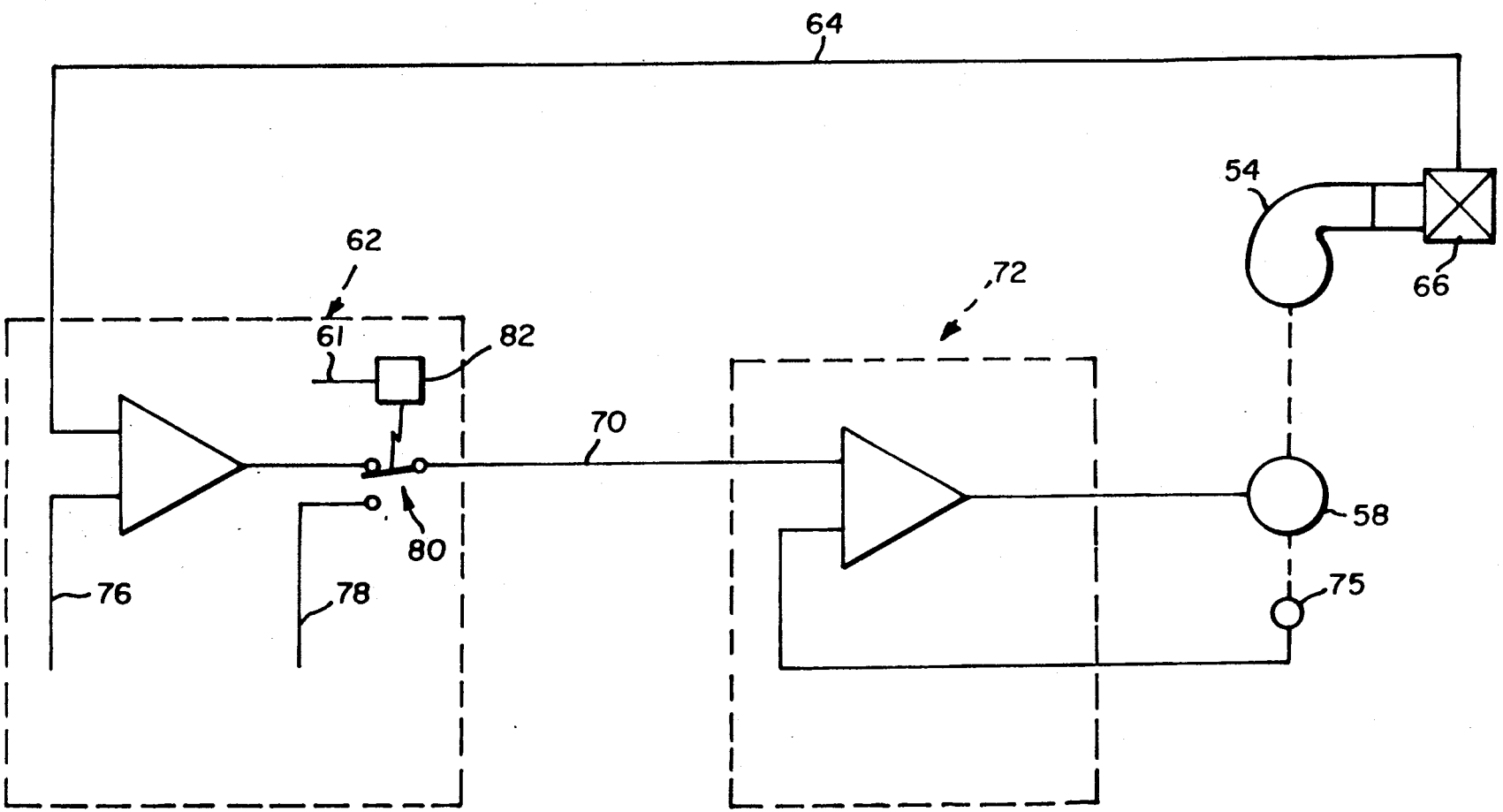
FIG. 2 is a diagram of the control circuit for the apparatus illustrated in FIG. 1.

FIG. 2 is a circuit diagram of the control circuit for achieving the desired degree of vacuum in the chamber 50. On line 76, a signal is applied indicative of the degree of vacuum desired during normal coating, that is, after start-up and without a splice near the bead. The signal on line 76 can be adjusted to take account of different coating compositions, different web speeds, different web materials and other parameters, as is known to those skilled in the art. On line 78, a signal is applied indicative of the the degree of vacuum to be applied during start-up and during passage of a splice through the bead. The signal need not be the same for both occurrences, but signals for both occurrences are applied on the line 78. A switch 80 is provided for selecting whether a normal coating or a start-up/splice mode signal is to be sent to the servo controller via line 70. The switch 80 is operated by an operating device 82 which takes a signal from line 61 from the splice detector 60. The operating device may also include an input indicative of web speed and may time operation of the switch in dependance on the web speed. If the web speed is constant, the detector may be so located that it is appropriate to implement change of the pressure differential across the bead as the splice is passing the detector.

It will be observed that when in the start-up/splice mode, the feedback, through line 64, from the pressure transducer 66, is not effective. It has been found that with the passage of the splice through the gap between the hopper lip and the web being of such short duration, the time taken for the pressure wave to reach the bead from the turbine, the turbine's speed having been rapidly increased, is relatively so long that there is hunting if there is pressure feedback. Thus, it has been found desirable in the embodiments which have been constructed, not to use the pressure feedback during start and splice modes.

In operation, at start up, the switch 80 is in its condition other than that shown in FIG. 2, so that a start reference signal is applied to line 70. This causes relatively high speed running of the turbine 54, whereby a relatively high vacuum is created in the chamber 50 so that a relatively large pressure differential across the bead is created. When stable coating condition has been achieved, the hopper having been moved so that the gap between the hopper lip and the web is appropriate for normal coating, the pressure differential is reduced by moving the switch 80. This operation of the switch may be under manual control if it is found that the length of time needed to gain stable, satisfactory coating is variable. With the switch 80 now in the condition shown in FIG. 2, the signal applied to the line 70 is controlled by the pressure differential setpoint signal applied on line 76.

When the splice detector 60 senses a splice, it signals the vacuum controller 62, which immediately, or with a delay determined by the path length displacement of the detector 60 from the bead and the speed of the web 12, causes the switch 80 to switch so that a higher pressure differential is created in the chamber 50. The switch 80 switches back after a short period of time sufficient to allow the splice to pass through the gap and for the disruption caused by passage of the splice, to decay.

It has been found that regulating the pressure differential across the bead by regulating the speed of the turbine which creates the pressure differential, produces a far more stable pressure differential during normal coating, than does the prior art which throttles a constant speed vacuum creating device.

Figure 3A:
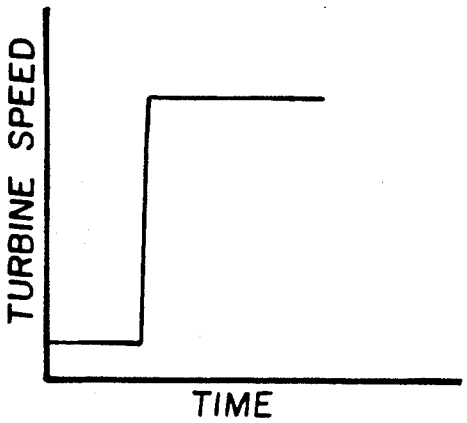
FIG. 3*a* illustrates a plot of turbine speed against time achievable in apparatus in accordance with the present invention.
Figure 3B:
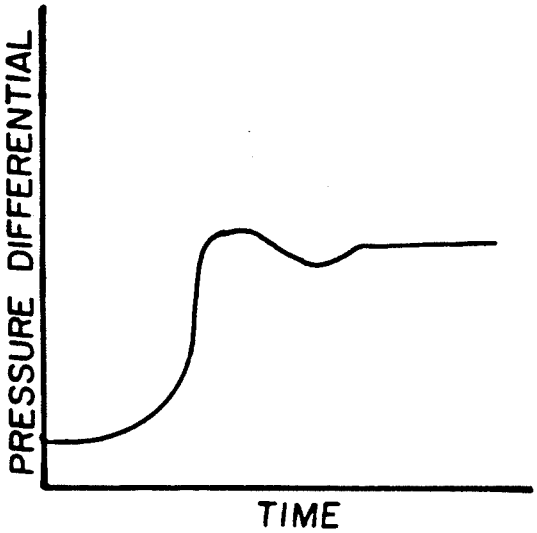
FIG. 3*b* illustrates a plot of pressure differential against time created by the turbine speeds illustrated in FIG. 3*a;*
Figure 4A:
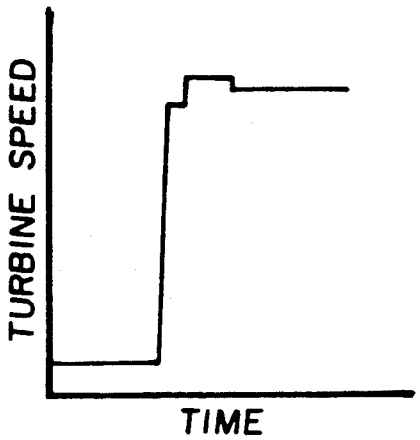
FIG. 4*a* illustrates another plot of turbine speed against time in apparatus in accordance with the present invention; and FIG; 4*b* illustrates a plot of pressure differential against time created by the turbine speeds illustrated in FIG. 3*a*.
Figure 4B:
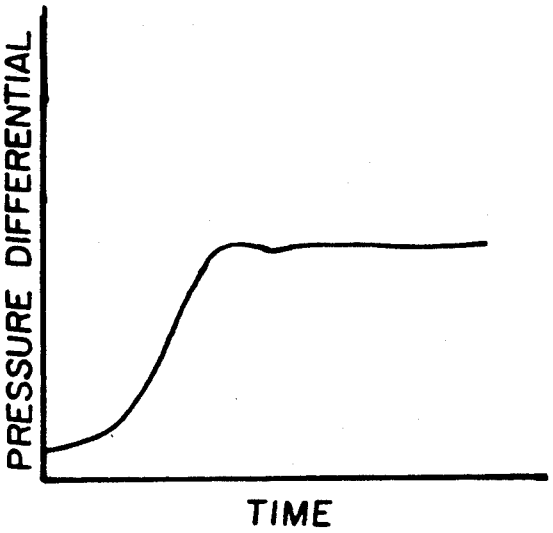

While it is possible to control accurately the speed of the motor driving the turbine, the change in pressure differential across the bead is not directly related to turbine speed during a speed change. There may be a delay in change of pressure occurring at the bead, after change in turbine speed. Also there may be some undesirable pressure oscillations. For example, reference is directed to FIG. 3*a* wherein the speed of the motor driving the turbine is shown as being stepped up. FIG. 3*b* shows the resulting pressure differential at the underside of the bead. It will be seen that after a fairly sharp increase in pressure differential there are some oscillations when it would be desirable that the pressure became steady at a new value. Such steady pressure at the new value as is shown in FIG. 4*b* may be achieved by controlling the speed of the turbine as shown in FIG. 4*a*. Such programmed changes could be applied through line 78. As can be seen in FIGS. 3*a* and 4*a*, the rate of change of turbine motor speed is great.

The invention has been described in detail with reference to a presently preferred embodiment, but it will be understood that variations and modifications can be effected within the spirit and scope of the invention.

What is claimed is:

1. Apparatus for use in bead coating a web with a photographic composition, including:

a coating roll adapted to back up the web during coating, said coating roll being mounted for rotation about a horizontal axis;

a slide hopper having a slide surface and a lip at the lower end of the slide surface;

means for positioning said slide hopper with said lip in coating proximity to said coating roll whereby a gap is created between the lip and a web on the roll;

means for supplying coating composition to said hopper for flowing down said slide surface and off said lip;

means for moving the web to be coated upwardly past the lip;

an enclosure under and open to the gap between the lip and a web on the coating roll;

means for applying a vacuum to the enclosure, said vacuum applying means including:

a turbine;

variable speed motor means for driving said turbine; and means for regulating the speed of the motor means.

2. Apparatus as claimed in claim 1, wherein said motor means includes an electric motor.

3. Apparatus for bead coating a web as claimed in claim 2, wherein said electric motor is an AC induction motor and said means for regulating the speed of the motor means includes AC servo drive means, whereby the speed of the motor means, and hence the degree of vacuum in the enclosure, may be changed.

4. A method of bead coating a web with a liquid composition including:

providing a slide hopper having a slide surface and a lip at the lower end of the slide surface;

feeding the liquid composition to the slide hopper whereby the composition flows down the slide surface and off the lip;

moving the web upwardly past the lip in predetermined spaced relationship therewith whereby the liquid composition bridges the gap between the lip and the web and is coated on the web;

providing a turbine and variable speed motor means for driving said turbine;

creating a pressure differential across the liquid composition where it bridges the gap between the hopper lip and the web by driving the turbine with the motor means; and varying the pressure differential by varying the speed of the motor means.

5. A method as claimed in claim 4, wherein the motor means provided is an AC induction motor and the speed of the motor is varied by varying the field orientation.

* * * * *